US005385124A

United States Patent [19]

Hillebrand et al.

[11] Patent Number: 5,385,124

[45] Date of Patent: Jan. 31, 1995

[54] ROLLER FOLLOWER AXLE

[75] Inventors: George A. Hillebrand, Hickory Corners; Bryan K. Blowers, Battle Creek, both of Mich.

[73] Assignee: Eaton Corporation, Cleveland, Ohio

[21] Appl. No.: 251,766

[22] Filed: May 31, 1994

[51] Int. Cl.[6] ..... F01L 1/14; F01L 1/24

[52] U.S. Cl. ..... 123/90.5; 123/90.51; 123/90.55; 74/569

[58] Field of Search ..... 123/90.48, 90.5, 90.51, 123/90.55, 90.42; 74/569

[56] References Cited

U.S. PATENT DOCUMENTS

| | | | |
|---|---|---|---|
| 3,255,513 | 6/1966 | Robinson et al. | 123/90.51 |
| 4,094,279 | 6/1978 | Kueny | 123/90.51 |
| 4,361,120 | 11/1982 | Kueny | 123/90.55 |
| 4,628,874 | 12/1986 | Barlow | 123/90.5 |
| 4,793,295 | 12/1988 | Downing | 123/90.5 |
| 5,099,807 | 3/1992 | Devine | 123/90.48 |
| 5,239,951 | 8/1993 | Rao et al. | 123/90.5 |
| 5,273,005 | 12/1993 | Philo et al. | 123/90.5 |

*Primary Examiner*—Andrew M. Dolinar
*Assistant Examiner*—Weilun Lo
*Attorney, Agent, or Firm*—Frank M. Sajovec

[57] ABSTRACT

A hydraulic roller tappet for an internal combustion engine wherein the tappet body is formed of hardenable cast iron, the roller axle is formed of a through hardened steel and wherein the axle bores in the body and the axle are dimensioned such that the axle is in floating relationship with the bores. In a preferred embodiment the axle is axially retained by retaining rings received in grooves formed in the body.

5 Claims, 1 Drawing Sheet

ROLLER FOLLOWER AXLE

The present invention relates to cam followers or tappets for the valve gear of an internal combustion engine, and particularly relates to cam followers of the type having a roller or wheel provided on the end thereof for rolling contact with the surface of a rotating lobe on the engine cam shaft. Tappets of the aforementioned type are known as roller followers and are employed to reduce friction between the cam shaft and the cam follower for the purpose of increasing the power output of the engine, i.e. reducing friction losses and to improve the wear life of the cam shaft and cam follower.

Roller cam followers and lash adjusters employing roller cam followers are well known in the art, the most commonly used configuration using a roller supported on a needle bearing which is mounted on an axle which is staked or otherwise fixed to the cam follower.

It has been found desirable in some instances to retrofit existing production internal combustion engines, and particularly engines for mass produced automotive applications, with roller follower tappets where the engine was originally designed and manufactured with tappets having the ends thereof in direct frictional sliding engagement with the lobe of the cam shaft. Where it is desired to retrofit an existing production automotive engine with roller follower tappets, it is desired to do so without otherwise altering the engine block to minimize changes in the remaining valve gear components. In order to accomplish such a retrofit of roller follower tappets, it is necessary to incorporate the roller on the end of a tappet substantially within the dimensional envelope of the existing engine tappet to eliminate the necessity of relocating the camshaft and minimize alterations to other valve gear components. In some cases it is necessary to provide a slot or recess in the end of the tappet in a manner so as to form a pair of spaced apart support portions extending from the end of the tappet, and to provide cross holes for receiving therein the axle of the roller with the roller nestled between the parallel support portions. In other cases a pocket can be formed at the end of the tappet body.

Where an existing production engine tappet incorporates therein internal hydraulic lash adjusting means, the material and the construction of the tappet body are dictated by the requirements of the tappet envelope, clearance and wear requirements. Prior to the conversion to roller followers it was very desirable to use hardenable iron for the tappet body, since the stresses applied to the body were relatively low and the carbides existing at the cam contacting surface of the body provided excellent wear characteristics. Also, the machinability of hardenable iron makes its use desirable from a production cost standpoint. When roller tappets are retrofitted into existing engines, however, the space constraints result in a relatively thin section between the axle holes and the bottom of the body. This causes high stresses in the region in operation, which can result in fracture of the body material in this area. Another problem which can occur in this situation is that due to the stresses applied at the axle/body interface there is a problem in retaining the axle within the body unless an aggressive form of retention is used, which adds to the fracture problem.

Various attempts have been made to provide reliable axle retention while avoiding fracturing of the body material, including press fitting the axle into the body, deforming the ends of the axle such as by orbital staking, and in using particular materials for the tappet body, such as nodular iron.

The most promising of these solutions has been the use of a steel axle, which is hardened in the central area and left relatively soft at the ends, which is then subjected to an orbital staking process to deform the ends for retention. Such retention method has not been entirely satisfactory, however, because in order to eliminate fracturing of the body material under load there are certain dimensional requirements which are very critical and very expensive to achieve. For example, the accuracy of the axle hole size is very critical to the staking process since the displaced axle material is moved into the hole surface, a large hole resulting in a low axle push-out force, and a small hole resulting in excessive body stresses and resulting in fractures. The axle length and the radius formed at the axle ends are also critical since the amount of material displaced by the staking operation must be controlled. The cost of selectively heat treating the axle is also a factor in making the staked axle design less than completely satisfactory.

Heretofore, a design wherein the axle is allowed to float within the body, without staking for retention, which would thus avoid the body stress problems associated with current designs, has not been given serious consideration for several reasons. For one, the fact that a floating axle will undergo rotation within the receiving holes has taught against such configuration because of perceived wear problems at the axle/body interface. Another perceived negative factor has been that due to the inertia of the lifter any clearance between the axle and the body would cause fatigue problems at relatively thin-sectioned lower end of the lifter body.

In accordance with the invention, however, it has been found that the excellent wear characteristics of a hardened steel axle running in a hardenable iron body, such as that heretofore used in flat-faced tappet applications, obviate any wear problems conventionally associated with the random rotation of an axle which is permitted to float within its receiving holes. Furthermore, since the hydraulic tappet will, by its very nature, take up all slack in the system in which it is installed, it has been discovered that the problem of fatigue at the lower end of the body is eliminated, since the floating axle does not contact that portion of the body holes under load.

In accordance with the above, the present invention provides a hydraulic roller tappet wherein the body is formed of hardenable iron, the axle is formed of hardened steel, and the receiving holes in the body and the axle are dimensioned such that the axle floats in the axle holes. The axle is retained axially by snap rings or the like.

Other advantages of the inventive design are that the random rotation of the axle allows the entire surface of the axle to be used during the course of the life of the engine, and that the floating axle provides greater self alignment of the roller outer diameter to the cam surface.

Other objectives and advantages of the inventions will be apparent from the following description, wherein.

Figure 1:
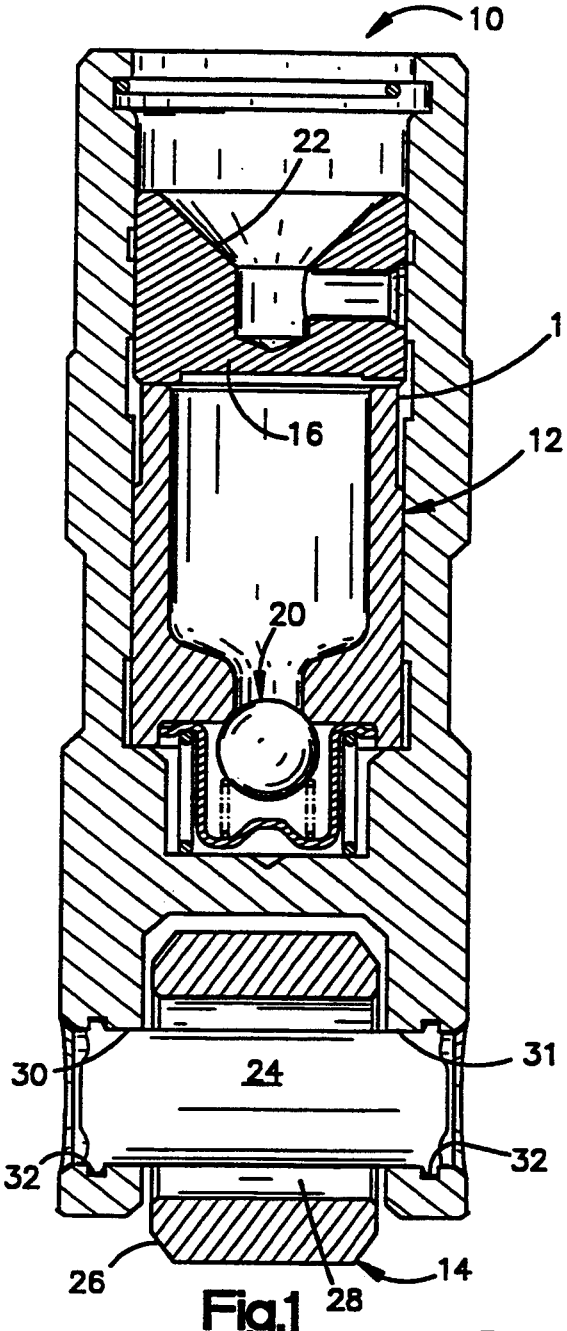
Fig.1 (PRIOR ART)
FIG. 1 is an elevation view, shown partly in section, of a prior art roller tappet.

Referring to FIG. 1, there is shown a prior art roller tappet comprising a body 10, a hydraulic lash adjusting mechanism 12, and a roller assembly 14 mounted on the body. The hydraulic mechanism, which is of conventional, well known construction and will not be described herein in detail, comprises first and second plunger elements 16 and 18 respectively and a check valve assembly 20. The tappets shown herein are configured for use in a push rod valve train; therefore, the first plunger element has a socket portion 22 formed therein to receive the spherical and of a valve actuating push rod. However, it should be understood that the first plunger can be configured to engage a rocker arm in an overhead cam valve train.

In the prior art tappet 10 the roller assembly 14 comprises an axle 24, which is received in a pocket formed in the bottom of the body, or between legs protruding form the bottom of the body, depending on the engine application, a roller 26 and a needle bearing 28 supporting the roller on the axle. As described above, the roller is initially a close sliding fit within aligned bores 30 and 31 formed in the body and is then subjected to a staking operation to deform the soft ends of the axle into retaining engagement with the body holes. In the prior art embodiment shown, annular grooves 32 are formed in the body, as shown in U.S. Pat. No. 4,628,874, to assist in relieving a portion of the stresses induced in the body by the staking process. As also described above, the length of the axle; as well as the radius formed at the axle ends prior to staking, and the fit of the axle within the body holes must be very closely controlled.

Figure 2:
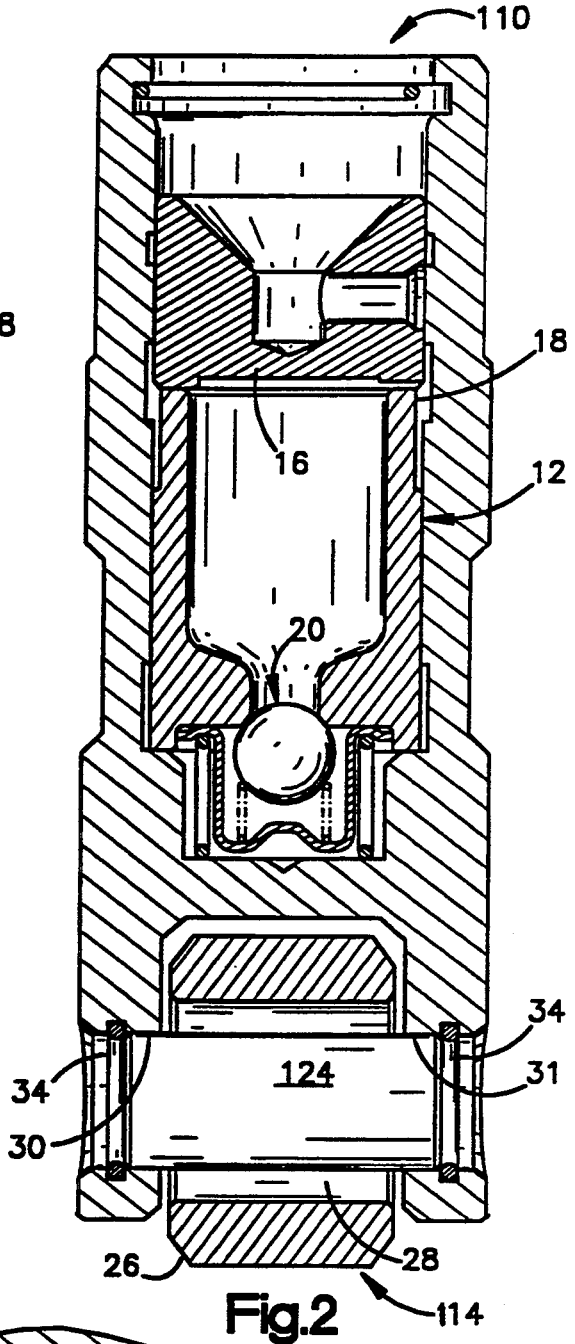
FIG. 2 is a view similar to FIG. 1, showing a roller tappet in accordance with the invention.

Referring to FIG. 2 the roller tappet in accordance with the invention comprises a body 110, a hydraulic lash mechanism 12 which is identical to the prior art mechanism, and a roller assembly 114, the roller assembly comprising an axle 124 received in bores 30 and 31, the roller 26, needle bearing 28 and retaining rings 34 received in grooves formed in the body.

Figure 3:
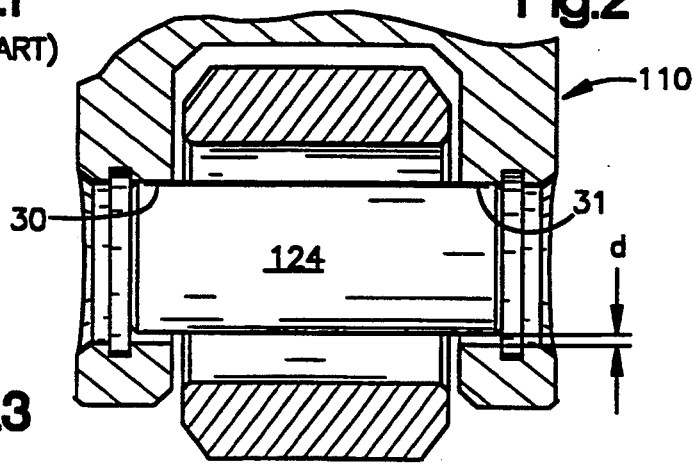
FIG. 3 is an enlarged view of a portion of the tappet shown in FIG. 2.

As shown in exaggerated form in FIG. 3, prior to the application of the retaining rings, the axle 124 is a relatively loose fit in the bores 30 and 31, leaving a diametric clearanced between the axle and the bore of $0.051 \pm 0.038$ mm. Also in accordance with the invention, the body is formed of hardenable iron (as opposed to nodular iron as used in certain prior art structures e.g. as described in U.S. Pat. No. 4,094,279), a preferred form having the following composition: carbon 3.0–3.4%, manganese 0.70–0.90%, phosphorous 0–0.2%, sulfur 0–0.1%, silicon 2.0–2.4%, chromium 0.90–1.25%, nickel 0.40–0.70%, and molybdenum 0.40–0.70%. In combination with the hardenable iron body, the axle is formed of a through hardened steel having a hardness of HRC 59/65, a preferred type being SAE 52100.

We claim:

1. A roller follower hydraulic tappet for the valve train of an internal combustion engine comprising a cylindrical body; a hydraulic element received within said body and operable to take up slack in said valve train; and a cam contacting roller assembly received within said body, said roller assembly comprising first and second aligned bores formed perpendicular to the longitudinal axis of said body, an axle received within said bores, a roller supported on said axle, and means to axially retain said axle within said bores; the improvement comprising said body being formed of hardenable iron, said axle being formed of hardened steel, and said axle being received in floating relationship to the interior diameter of said first and second bores.

2. Apparatus as claimed in claim 1, in which said body is formed of hardenable cast iron consisting essentially of 3.0–3.4% carbon, 0.70–0.90% manganese, 0–0.2% phosphorus, 0–0.1% sulfur, 2.0–2.4% silicon, 0.90–1.25% chromium, 0.40–0.70% nickel and 0.40–0.70% molybdenum.

3. Apparatus as claimed in claim 1, in which said axle is formed of through hardened steel having a hardness of HRC 59/65.

4. Apparatus as claimed in claim 1, in which said means to retain said axle comprises retaining rings received in grooves formed in said first and second bores.

5. Apparatus as claimed in any one of claims 1 through 4, in which there is a diametric clearance of 0.013 mm to 0.089 mm between said axle and said first and second bores.

* * * * *